US008863844B2

(12) United States Patent
Hande

(10) Patent No.: US 8,863,844 B2
(45) Date of Patent: Oct. 21, 2014

(54) SUBSEA ARRANGEMENT

(75) Inventor: Olav Hande, Asker (NO)

(73) Assignee: Vetco Gray Scandinavia AS, Sandvika (NO)

( * ) Notice: Subject to any disclaimer, the term of this patent is extended or adjusted under 35 U.S.C. 154(b) by 313 days.

(21) Appl. No.: 13/327,806

(22) Filed: Dec. 16, 2011

(65) Prior Publication Data

US 2012/0152553 A1 Jun. 21, 2012

(51) Int. Cl.

| | |
|---|---|
| ***E21B 34/00*** | (2006.01) |
| ***E21B 41/00*** | (2006.01) |
| ***E21B 43/01*** | (2006.01) |

(52) U.S. Cl.

CPC ..... *E21B 43/01* (2013.01); *E21B 41/0007* (2013.01)

USPC ..... 166/335; 166/363; 166/324; 166/332.7

(58) Field of Classification Search

CPC ..... B63B 2207/02

USPC ..... 166/321, 324, 322, 325, 332.2, 332.7, 166/332.8, 345, 351; 441/29

See application file for complete search history.

(56) References Cited

U.S. PATENT DOCUMENTS

| | | | | |
|---|---|---|---|---|
| 1,009,943 | A * | 11/1911 | Trainee | 417/115 |
| 3,181,182 | A * | 5/1965 | Delaruelle et al. | 441/29 |
| 3,273,181 | A * | 9/1966 | Beck, Jr. | 441/29 |
| 3,703,207 | A | 11/1972 | Horton | |
| 6,615,923 | B1 | 9/2003 | Lay, Jr. et al. | |
| 7,044,165 | B2 | 5/2006 | Malenfant et al. | |
| 8,056,618 | B2 * | 11/2011 | Wagner et al. | 166/57 |
| 2010/0140014 | A1 | 6/2010 | Han | |

FOREIGN PATENT DOCUMENTS

| | | |
|---|---|---|
| WO | WO 01/63088 A1 | 8/2001 |

OTHER PUBLICATIONS

Norwegian Search Report from Norwegian App. No. 20101772, dated Jul. 14, 2011, 2 pages.

GB Search Report, Application No. GB1121617.3, Dated Feb. 22, 2012.

* cited by examiner

*Primary Examiner* — James Sayre

(74) *Attorney, Agent, or Firm* — Bracewell & Giuliani LLP

(57) ABSTRACT

A subsea arrangement comprising an external casing and a pressure equalizing valve for equalization of the fluid pressure in an internal space of the casing. The pressure equalizing valve comprises a swing arm and a valve member arranged inside the casing. The swing arm carries the valve member and is pivotable about a pivot axis, under the effect of an external fluid pressure acting on the valve member, from a resting position, in which the valve member covers an opening provided in the casing and prevents fluid flow through this opening, to a raised position, in which the valve member uncovers said opening and allows fluid flow through it from the surroundings into said space for equalization of the fluid pressure therein when the arrangement is lowered into the sea. The swing arm is pivotable from the raised position to the resting position under the effect of gravity.

13 Claims, 1 Drawing Sheet

SUBSEA ARRANGEMENT

CROSS-REFERENCE TO RELATED APPLICATION

This application claims priority to and the benefit of co-pending Norwegian Application No. 20101772, by Olav Hande, filed on Dec. 17, 2010, entitled "A SUBSEA ARRANGEMENT," which application is incorporated herein by reference.

FIELD OF THE INVENTION

The present invention relates to a subsea arrangement comprising an external casing, which encloses an internal space for accommodating fluid, and a pressure equalizing valve for equalization of the fluid pressure in said space.

BACKGROUND OF THE INVENTION

In connection with oil and gas producing installations it is well known that rapid cooling of the production fluid during normal production and particularly during temporary interruption of the production may result in the formation of hydrates, which may cause clogging of pipes and pipe connections. To delay cooling of the production fluid in case of an interruption of the production, some form of thermal insulation and heat storage medium has to be provided to the element through which the production fluid flows. Said element could for instance be a pipe, a manifold, a valve, a connector etc. WO 01/63088A1 and WO 2006/106406A1 disclose the use of a so-called heat bank for thermally insulating one or more elements included in a subsea installation. The heat bank comprises a casing, which is arranged to enclose a fluid having heat-storing capacity, for instance sea water, and which has an internal space for receiving said element or elements and said fluid with the fluid surrounding the respective element so as to allow the fluid to delay cooling of the element by means of heat stored in the fluid. Thus, by means of heat stored in the fluid inside the casing, the heat bank protects the respective element from cooling too rapidly. The fluid in the heat bank is heated by heat emitted from the protected element or elements during normal operation.

When a heat bank, or any other arrangement intended to contain fluid enclosed in a casing, is lowered into the sea, the casing will be subjected to an external load caused by the hydrostatic pressure of the surrounding sea water. The hydrostatic pressure and thereby the external load on the casing will gradually increase as the depth increases. In order to prevent the casing from collapsing at greater sea depths due to this external load, the pressure of the fluid inside the casing has to be balanced against the ambient sea water pressure by means of a pressure balancing device. There is a need for a simple and reliable pressure balancing device that is suitable for use in a heat bank or any other subsea arrangement that is to be lowered into the sea.

SUMMARY OF THE INVENTION

The object of the present invention is to provide a subsea arrangement having a simple and reliable pressure equalizing valve for balancing the pressure of a fluid inside a casing of the subsea arrangement against ambient sea water pressure.

According to the invention, this object is achieved by a subsea arrangement having the features defined in claim 1.

The subsea arrangement of the present invention comprises an external casing, which encloses an internal space for accommodating fluid, and a pressure equalizing valve for equalization of the fluid pressure in said space. The pressure equalizing valve comprises a swing arm and a valve member arranged inside the casing, the valve member being carried by the swing arm. The swing arm has a first end articulately connected to the casing through a joint so as to be pivotable in relation to the casing about a horizontal or at least essentially horizontal pivot axis. The valve member is secured to the swing arm at a distance from this first end of the swing arm. The swing arm is pivotable about said pivot axis in a first direction, under the effect of an external fluid pressure acting on the valve member, from a resting position, in which the valve member covers an opening provided in the casing and prevents fluid flow through this opening, to a raised position, in which the valve member uncovers said opening and allows fluid flow through the opening from the surroundings into said internal space for equalization of the fluid pressure therein when the subsea arrangement is lowered into the sea. The swing arm is pivotable in the opposite direction, under the effect of gravity, from the raised position to the resting position.

Thus, the pressure equalizing valve will automatically uncover the opening in the casing under the effect of the external hydrostatic pressure acting on the valve member when the subsea arrangement is lowered into the sea and thereby allow sea water to flow into the internal space of the casing. Hereby, the pressure of the fluid in the internal space of the casing is balanced against the ambient sea water pressure during the lowering of the subsea arrangement into the sea. When the subsea arrangement has been installed at a subsea installation, the valve member of the pressure equalizing valve will, under the effect of gravity, keep the opening in the casing closed and thereby prevent fluid flow into or out of said internal space through this opening. This pressure equalizing valve has a very simple and reliable construction and can be used in any subsea arrangement where an inflow of sea water into an internal space of the subsea arrangement can be accepted during the lowering of the subsea arrangement into the sea. When the subsea arrangement has been installed at the desired depth of the sea, the pressure equalizing valve has fulfilled its pressure equalizing function and no more movement of the valve member is required. The valve member is then only to remain in its resting position covering the opening in the casing, and the swing arm is consequently of no more use and may be allowed to rust away. Thus, the swing arm and its joint can be made of inexpensive materials and be given a simple construction.

Further advantages as well as advantageous features of the subsea arrangement according to the present invention will appear from the dependent claims and the following description.

BRIEF DESCRIPTION OF THE DRAWINGS

With reference to the appended drawings, a specific description of preferred embodiments of the invention cited as examples follows below. In the drawings.

DETAILED DESCRIPTION OF THE INVENTION

Figure 1:
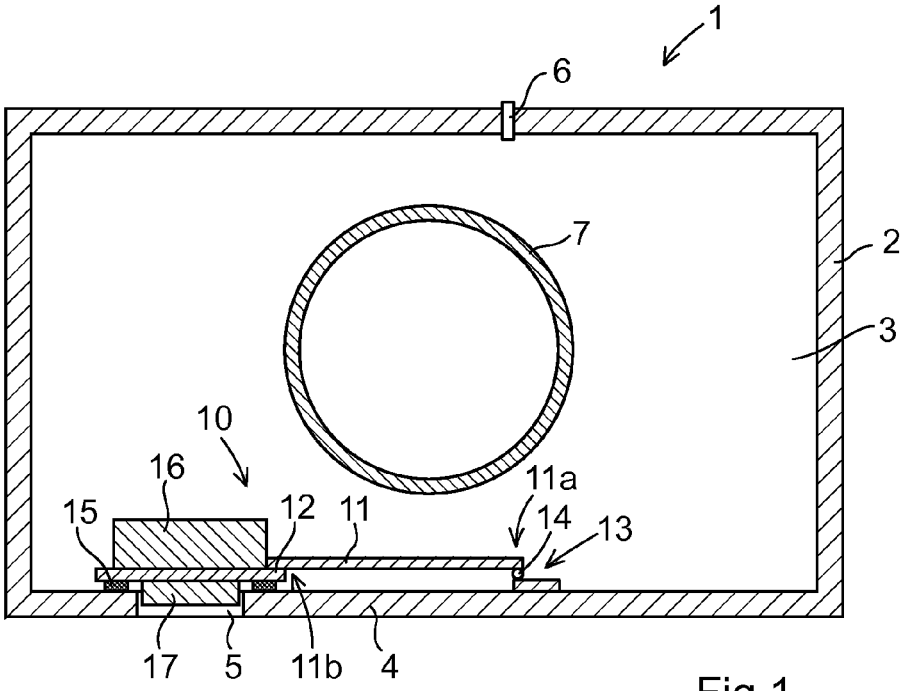
FIG. 1 is a schematic illustration of a subsea arrangement according to the invention, as seen in a longitudinal section with the pressure equalizing valve in a closed position.
Figure 2:
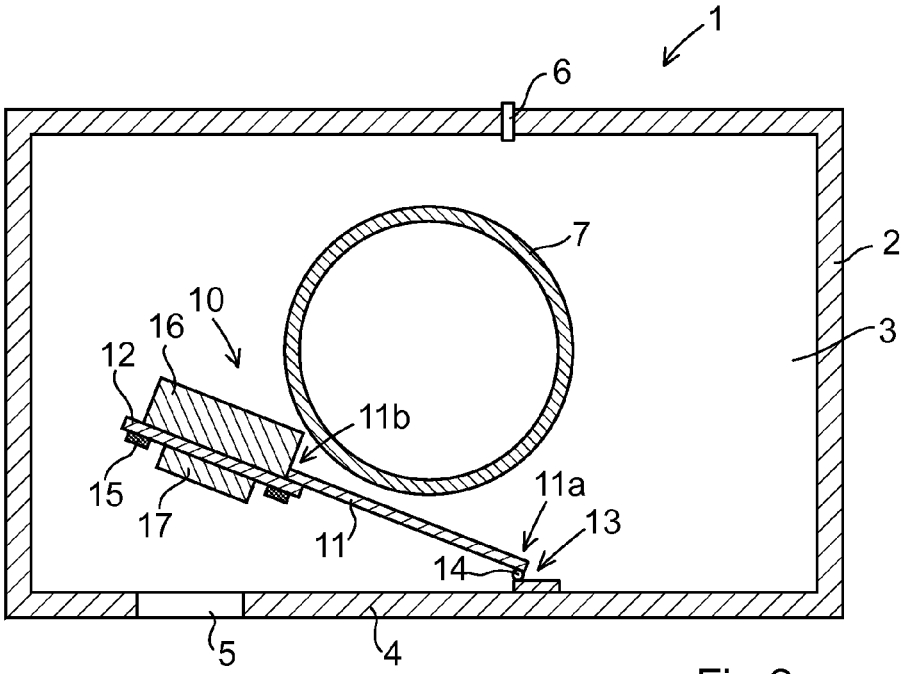
FIG. 2 shows the subsea arrangement of FIG. 1 with the pressure equalizing valve in an open position, in accordance with the invention.

A subsea arrangement 1 according to an embodiment of the present invention is illustrated in FIGS. 1 and 2.

The subsea arrangement 1 comprises an external casing 2, which encloses an internal space 3 intended to contain fluid. The subsea arrangement 1 is provided with a pressure equalizing valve 10 for equalization of the fluid pressure in said space 3. The pressure equalizing valve 10 comprises a swing arm 11 and a valve member 12 arranged inside the casing 2. The swing arm 11 is at one 11 a of its ends, here denominated first end, articulately connected to the casing 2 through a joint 13, which forms a horizontal or at least essentially horizontal pivot axis 14 for the swing arm. The swing arm 11 is pivotable in relation to the casing 2 about this pivot axis 14. The valve member 12 is carried by the swing arm 11 and is secured to the swing arm at a distance from said first end 11*a* of the swing arm, i.e. at a distance from the joint 13. In the illustrated example, the valve member 12 is secured to the outer second end 11*b* of the swing arm. The valve member 12 may alternatively be secured to the swing arm 11 at a suitable position between the ends 11*a*, 11*b* thereof.

In the illustrated example, the swing arm 11 is pivotally mounted to a bottom wall 4 of the casing 2 on the inner side of this bottom wall.

The swing arm 11 is pivotable about the pivot axis 14 in a first direction, under the effect of an external fluid pressure acting on the valve member 12, from a resting position (see FIG. 1), in which the valve member 12 covers an opening 5 provided in the bottom wall 4 of the casing 2 and prevents fluid flow through this opening, to a raised position (see FIG. 2), in which the valve member 12 uncovers said opening 5 and allows fluid flow through the opening from the surroundings into the internal space 3 for equalization of the fluid pressure therein when the subsea arrangement 1 is lowered into the sea. The swing arm 11 is pivotable in the opposite direction, under the effect of gravity, from the raised position to the resting position. The pressure equalizing valve 10 acts like a non-return valve preventing fluid in the internal space 3 of the casing from flowing out into the surroundings through the opening 5 in the bottom wall 4 of the casing, while allowing fluid to flow from the surroundings into the internal space 3 of the casing through said opening 5 when the pressure acting on the outer side of the valve member 12 exceeds the pressure acting on the inner side thereof to a given extent. Hereby, the difference between the fluid pressure inside the casing 2 and the fluid pressure on the outside of the casing is equalized, and the external load on the casing caused by the hydrostatic pressure of the surrounding sea water is thereby eliminated.

A stop member (not shown) could be arranged in the internal space 3 of the casing in order to restrict the movement of the swing arm 11 in the above-mentioned first direction.

An air vent 6 is provided in an upper part of the casing 2 to allow release of air from the internal space 3 through this air vent when sea water enters into the space 3 through the opening 5 during a lowering of the subsea arrangement 1 into the sea.

A sealing member 15 surrounding the opening 5 is provided between the valve member 12 and the casing 2 when the swing arm 11 is in the resting position with the valve member 12 covering the opening 5. In the illustrated example, the sealing member 15 is mounted to the valve member 12, but it may alternatively be mounted to the bottom wall 4 of the casing.

One or more weights 16 may be mounted to the valve member 12 in order to increase the force of gravity acting to maintain the valve member 12 in its closed position. Alternatively, the valve member 12 may in itself be given a construction of sufficient mass. The valve member 12 is made of corrosion resistant material, for instance stainless steel. In the illustrated example, the valve member 12 has the form of a plate, with a weight 16 mounted to the upper side of the plate and a ring-shaped sealing member 15 mounted to the under side of the plate.

The valve member 12 preferably comprises a part 17 of heat insulation material, which is received on and/or inside the opening 5 when the swing arm 11 is in the resting position with the valve member 12 covering the opening. In the illustrated example, such a part 17 of heat insulation material is arranged on the under side of the valve member and dimensioned to be received inside the opening 5 when the swing arm 11 is in the resting position with the valve member 12 covering the opening.

When the subsea arrangement 1 is lowered into the sea and reaches such a depth that the external load on the valve member 12 caused by the hydrostatic pressure of the surrounding sea water exceeds the force of gravity acting on the valve member, the valve member 12 will automatically raise from the bottom wall 4 of the casing together with the swing arm 11 to uncover the opening 5 in the casing and allow sea water to flow into the internal space 3 of the casing. When sea water enters into the internal space 3 of the casing, air contained in said space 3 is allowed to escape into the surroundings through the air vent 6 at the upper part of the casing 2. Hereby, the pressure of the fluid in the internal space 3 of the casing is balanced against the ambient sea water pressure. Under the effect of gravity, the valve member 12 will automatically return to the closed position to cover the opening 5 in the casing 2 when the pressure of the fluid in the internal space 3 of the casing has been balanced against the ambient sea water pressure. When the subsea arrangement 1 has been installed at a subsea installation, the fluid pressure in the internal space 3 of the casing will be essentially equal to the pressure of the surrounding sea water and the valve member 12 will, under the effect of gravity, keep the opening 5 closed and thereby prevent fluid flow into or out of the internal space 3 through this opening.

In the illustrated embodiment, the subsea arrangement 1 is a heat bank for thermally insulating one or more elements 7 of a subsea installation. In this case, the internal space 3 of the casing 2 is arranged to accommodate a fluid having heat-storing capacity, for instance sea water, and said element 7 or elements is/are received in said internal space 3 with the fluid surrounding the element or elements so as to allow the fluid to delay cooling of the element or elements by means of heat stored in the fluid. The casing 2 prevents the fluid contained in the space 3 from flowing out into the surroundings. The casing 2 is preferably of thermally insulating material and/or provided with layers of thermally insulating material. The fluid enclosed in the casing 2 is intended to be heated by heat emitted from the element 7 or elements during normal operation. If the heat input to the element 7 or elements and thereby the temperature thereof would be decreased for some reason, the heat stored in the enclosed fluid will slow down the cooling of the element 7 or elements caused by the surrounding cold sea water. The heat bank could for instance be arranged to protect a subsea installation or a part thereof from cooling, such as for instance a pipe, a pipe section, a pipe connection, a valve or a valve section of a subsea oil and/or gas producing installation. Consequently, the element received in the internal space 3 of the casing could for instance constitute a part of a subsea piping system for processing or transporting oil and/or gas.

In the illustrated example, an element 7 in the form of a pipe extends through the internal space 3 of the casing.

The invention is of course not in any way restricted to the embodiments described above. On the contrary, many possibilities to modifications thereof will be apparent to a person with ordinary skill in the art without departing from the basic idea of the invention such as defined in the appended claims.

What is claimed is:

1. A subsea arrangement arranged to form a heat bank for thermally insulating one or more elements of a subsea installation, the subsea arrangement comprising:

an external casing enclosing an internal space arranged to accommodate seawater therein having a heat-storing capacity, and arranged to receive said one or more elements of the subsea installation when operationally employed subsea so as to allow heat stored in the seawater within the internal space surrounding the one or more elements to slow cooling of the one or elements, and a pressure equalizing valve for equalization of fluid pressure in said internal space, comprising:

a swing arm;

a valve member arranged inside the casing, the valve member being carried by the swing arm; and a first end on the swing arm being articulately connected to the casing through a joint so as to be pivotable in relation to the casing about a horizontal or at least essentially horizontal pivot axis, the valve member being secured to the swing arm at a distance from the first end of the swing arm;

wherein the swing arm is pivotable about the said pivot axis in a first direction, under the effect of an external fluid pressure acting on the valve member, from a resting position in which the valve member covers an opening provided in the casing to prevent the seawater from flowing through this opening, to a raised position in which the valve member uncovers said opening to allow the seawater to flow through the opening from the surroundings into said internal space for equalization of the fluid pressure therein when the subsea arrangement is lowered into the sea, and wherein the swing arm is pivotable in a second direction, under the effect of gravity, from the raised position to the resting position to thereby prevent seawater from flowing into and out of said internal space when the fluid pressure in said internal space is balanced against the external fluid pressure acting on the valve body, the second direction being opposite the first direction.

2. A subsea arrangement according to claim 1, wherein a sealing member surrounding said opening is provided between the valve member and the casing when the swing arm is in the resting position with the valve member covering the opening.

3. A subsea arrangement according to claim 2, wherein the sealing member is mounted to the casing.

4. A subsea arrangement according to claim 2, wherein the sealing member is mounted to the valve member.

5. A subsea arrangement according to claim 1, wherein one or more weights are mounted to the valve member.

6. A subsea arrangement according claim 1, wherein the valve member comprises a part of a heat insulation material, which is received on or inside said opening when the swing arm is in the resting position with the valve member covering the opening.

7. A subsea arrangement according to claim 1, wherein an air vent is provided in an upper part of the casing to allow release of air from said internal space.

8. A subsea arrangement according to claim 1, wherein the swing arm is pivotally mounted to a bottom wall of the casing through said joint.

9. A subsea arrangement according to claim 1, wherein the valve member has the form of a plate.

10. A subsea arrangement arranged to form a heat bank for thermally insulating one or more elements of a subsea installation, the subsea arrangement comprising:

an external casing enclosing an internal space for accommodating sea water therein, and arranged to receive said one or more elements of the subsea installation such that the seawater surrounds the one or more elements when the subsea arrangement is operationally employed; and a pressure equalizing valve for equalization of the fluid pressure in said internal space, comprising:

a swing arm;

a valve member arranged inside the casing, the valve member being carried by the swing arm; and a first end on the swing arm being articulately connected to the casing through a joint so as to be pivotable in relation to the casing about a horizontal or at least essentially horizontal pivot axis, the valve member being secured to the swing arm at a distance from the first end of the swing arm;

wherein the swing arm is pivotable about the said pivot axis in a first direction, under the effect of an external fluid pressure acting on the valve member, from a resting position in which the valve member covers an opening provided in the casing to prevent the seawater from flowing out of the internal space through the opening, to a raised position in which the valve member uncovers the opening to allow the seawater to flow through the opening and into said internal space for equalization of the fluid pressure therein when the subsea arrangement is lowered into the sea, and wherein the swing arm is pivotable in a second direction, under the effect of gravity, from the raised position to the resting position, the second direction being opposite the first direction.

11. A subsea arrangement according to claim 10, wherein a sealing member surrounding said opening is provided between the valve member and the casing when the swing arm the resting position with the valve member covering the opening.

12. A subsea arrangement according to claim 11, wherein the sealing member is mounted to the casing.

13. A subsea arrangement according to claim 11, wherein the valve member comprises a part of a heat insulation material which is received on or inside said opening when the swing arm is in the resting position with the valve member covering the opening.

* * * * *